US010433596B2

(12) United States Patent
Baumann

(10) Patent No.: US 10,433,596 B2
(45) Date of Patent: Oct. 8, 2019

(54) COMBINATION HAND MUFF AND PURSE

(71) Applicant: Diane Baumann, Baldwin, NY (US)

(72) Inventor: Diane Baumann, Baldwin, NY (US)

( * ) Notice: Subject to any disclaimer, the term of this patent is extended or adjusted under 35 U.S.C. 154(b) by 0 days.

(21) Appl. No.: 15/984,593

(22) Filed: May 21, 2018

(65) Prior Publication Data

US 2018/0263311 A1 Sep. 20, 2018

Related U.S. Application Data

(63) Continuation-in-part of application No. 13/710,843, filed on Dec. 11, 2012, now abandoned.

(51) Int. Cl.

| | |
|---|---|
| ***A41D 15/04*** | (2006.01) |
| ***A41D 5/00*** | (2006.01) |
| ***A63H 3/00*** | (2006.01) |
| ***A63H 33/00*** | (2006.01) |
| ***A45C 15/00*** | (2006.01) |
| ***A45C 3/06*** | (2006.01) |
| ***A63H 3/02*** | (2006.01) |
| ***A45C 9/00*** | (2006.01) |
| ***A41D 13/08*** | (2006.01) |
| *A45F 5/00* | (2006.01) |

(52) U.S. Cl.

CPC ..... *A41D 15/04* (2013.01); *A41D 5/003* (2013.01); *A41D 13/081* (2013.01); *A45C 3/06* (2013.01); *A45C 9/00* (2013.01); *A45C 15/00* (2013.01); *A63H 3/003* (2013.01); *A63H 3/005* (2013.01); *A63H 3/02* (2013.01); *A63H 33/004* (2013.01); *A41D 5/006* (2013.01); *A41D 2400/48* (2013.01); *A45F 2005/006* (2013.01)

(58) Field of Classification Search

CPC ..... A41D 15/04; A41D 5/003; A41D 5/006; A45C 3/06; A45C 9/00; A45C 15/00; A45C 3/14; A45D 3/14; A63H 3/003

USPC ..... 2/66

See application file for complete search history.

(56) References Cited

U.S. PATENT DOCUMENTS

| | | | | | |
|---|---|---|---|---|---|
| 53,760 | A | * | 4/1866 | Mahler | A41D 13/081 2/66 |
| 72,049 | A | * | 12/1867 | King | A41D 13/081 2/66 |
| 104,780 | A | * | 6/1870 | Seldis | A41D 13/081 2/66 |
| 135,163 | A | * | 1/1873 | Seldis | A41D 13/081 2/66 |
| 238,606 | A | * | 3/1881 | Pass | A41D 13/081 2/66 |

(Continued)

*Primary Examiner* — Alissa L Hoey

(74) *Attorney, Agent, or Firm* — Williams Intellectual Property; Benjamin F. Williams

(57) ABSTRACT

A combination hand muff and purse is rendered in the form of an animal passant in profile. The present combination and muff and purse is exteriorly fitted with flocculence reminiscent of the animal's coat. An open central cavity is surrounded by a first side, a rear side, a top side, and a bottom side, wherein a user may place their hands through each of a first end and a second end to warm interior to the central cavity. At least a first pocket is disposed longitudinally upon the top side wherein a shoulder strap is concealable for storage, and deployable for attachment at each of a pair of attachment loops whereby the present combination hand muff and purse is portable hands-free.

6 Claims, 3 Drawing Sheets

(56) References Cited

U.S. PATENT DOCUMENTS 246,827 A * 9/1881 Silberstein ..... A41D 13/081 2/66
282,391 A * 7/1883 Smith ..... A41D 13/081 2/66
526,950 A * 10/1894 Sprung ..... A41D 13/081 2/66
784,857 A * 3/1905 Grushoff ..... A41D 13/081 2/66
950,571 A * 3/1910 Miller ..... A41D 13/081 2/66
1,300,088 A * 4/1919 Wright ..... A41D 13/081 2/66
1,630,844 A * 5/1927 Hall ..... A45C 11/008 16/111.1
1,638,594 A * 8/1927 Myers ..... A45C 1/02 229/116.3
1,745,590 A * 2/1930 Stanger ..... A45C 3/14 190/100
2,014,256 A * 9/1935 Kramer ..... A45C 3/14 2/66
2,175,319 A * 10/1939 Rubenstein ..... A45C 3/06 150/120
2,504,551 A * 4/1950 Levinson ..... A45C 13/08 150/111
2,557,280 A * 6/1951 Hahn ..... A41D 15/04 2/66
2,591,379 A * 4/1952 Schradermeier ..... A45C 3/00 150/106
4,862,519 A * 9/1989 Bull ..... A45C 1/04 2/66
D313,696 S * 1/1991 Senitt ..... D21/613
D313,697 S * 1/1991 Senitt ..... D21/617
5,139,187 A * 8/1992 Fowler ..... A41D 13/081 2/162
5,499,401 A * 3/1996 Heinmiller ..... A41D 13/081 2/208
D624,748 S * 10/2010 Gold ..... D3/216
8,108,946 B2 * 2/2012 Myers ..... A41D 13/081 2/65
2005/0022286 A1 * 2/2005 Noble ..... A41D 27/08 2/69
2008/0115254 A1 * 5/2008 Galkov ..... A41D 3/00 2/108

* cited by examiner

COMBINATION HAND MUFF AND PURSE

CROSS-REFERENCE TO RELATED APPLICATIONS

This Continuation-in-Part Application claims the benefit of application Ser. No. 13/710,843 filed on Dec. 11, 2012

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Handbags and hand muffs are known in the prior art. Most comprise simple structures rendered for enabling placement of the hands interior to a muff. For example, U.S. Pat. No. 8,108,946 describes a muff with compartments, or pockets. However, each of these compartments or pockets is devised for each of a user's hands thereby separated by a dividing wall. The muff is not devised to serve additionally as a purse or a tote.

U.S. Pat. No. 4,862,519, discloses a fanny pack that is convertible to a hand muff. The fanny pack provides for storage and portability of additional items and converts into a muff or hand warmer when a releasable fastening means are deployed to enable access to a muff stored within a rectangular pocket.

What is needed is a combined muff and purse that presents an exterior devised to resemble the form of an animal whereby flocculent or other insulating material reminiscent of said animal's coat is presented to warm the hands of a user as a muff and a plurality of pockets disposed in at least a front side of said combined muff and purse enables storage and portage of items and accouterments therein when a shoulder strap is attached to the combined muff and purse for carriage thereby.

FIELD OF THE INVENTION

The present invention relates to combination muffs and handbags, and more particularly to a combination muff and purse devised in the form or an animal whereby a user may warm their hands while porting a variety of items and accouterments interior to a plurality of pockets disposed at least on a front side thereof.

OBJECTS OF THE INVENTION

One object of the invention is to develop a convertible apparel device that can be both a hand muff and a hand bag. Another object of the invention is to develop a toy for children. Yet another object of the invention is to produce apparel with a collapsible strap. Another object of the invention is to develop apparel where the shoulder strap is stored in a pouch until used.

SUMMARY OF THE INVENTION

The present combination hand muff and purse had been devised to enable portage of accouterments while enabling a user to warm their hands interior to an open central cavity, disposed between a front side and a rear side, a top side and a bottom side, and accessible at each of a first end and a second end. The present combination muff and purse has been devised in the form of an animal, to resemble a cartooned animal or character in passant profile.

The present combination hand muff and purse, therefore, includes a flocculent exterior devised to resemble the animal's coat while rendering insulating properties to the central cavity wherein a user may warm their hands. A head member, disposed at the first end proximal the top side, presents a face that may be disposed facing up (at the user wearing the device), facing down (away from the user wearing the device), or anteriorly forwards, towards viewers observing the user wearing the device. A tail member is disposed at the second end and a plurality of leg members is disposed depending from the rear side proximal the bottom side. Thus the appearance of an animal passant is discernable to passersby.

The head member may include eyes, ears, a snout, and other elements (such as bows or other decorative additions devised to feminize the animal) whereby a user's dress is complementary relative the combination hand muff and purse.

A shoulder strap is attachable at each of a pair of attachment loops for portage of the device hands-free. The shoulder strap may be concealable interior to a first pocket disposed upon the top side of the combined hand muff and purse.

The present combination hand muff and purse, therefore, presents the characterization of an animal while enabling portage of items and accouterments and enabling a user to warm their hands interior to a central cavity insulated by a flocculent material devised to resemble the animal's coat.

BRIEF DESCRIPTION OF THE DRAWINGS

Figures

DETAILED DESCRIPTION OF THE DRAWINGS

Figure 1:
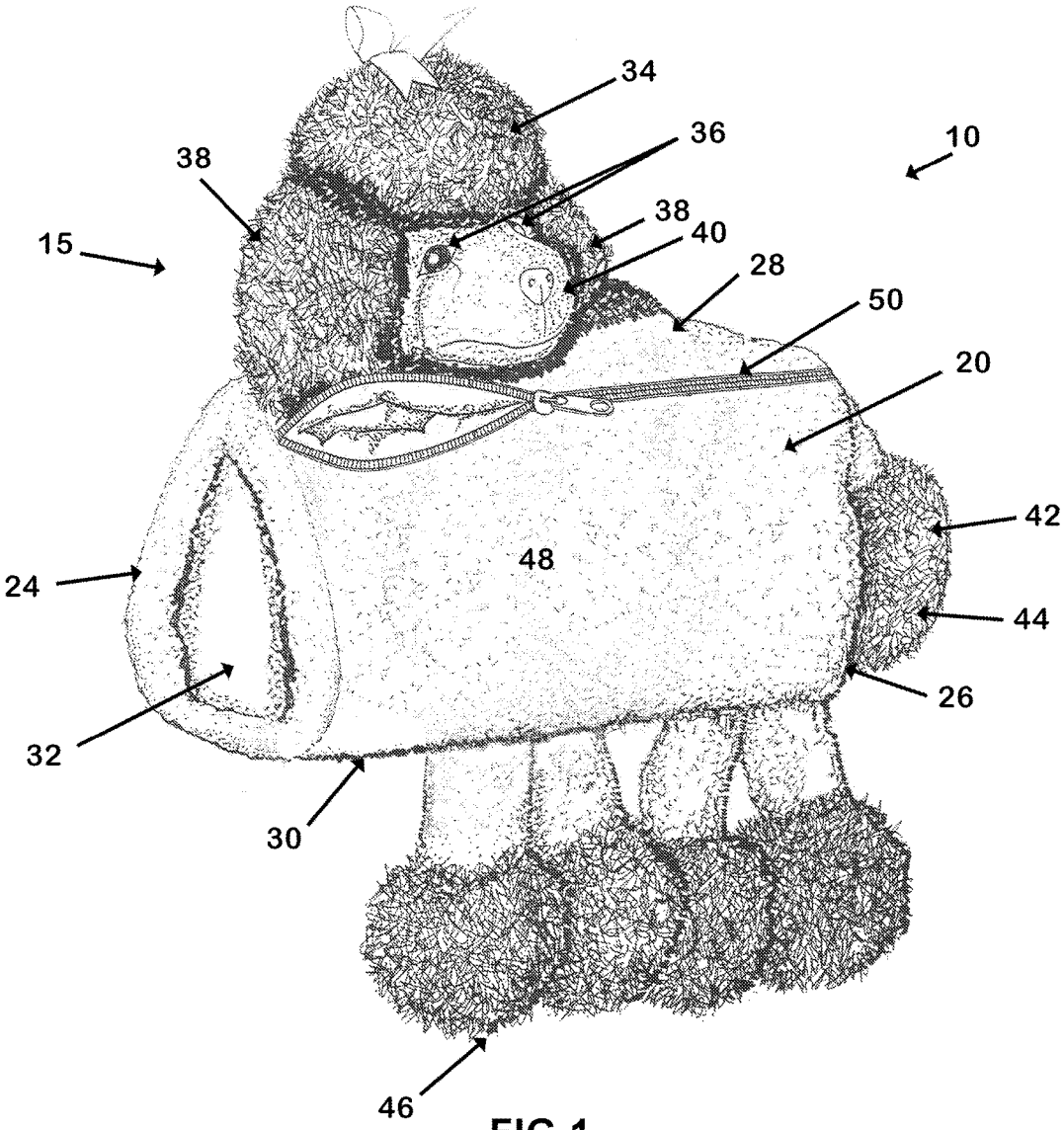
FIG. 1 is an front elevation view of an example embodiment.
Figure 2:
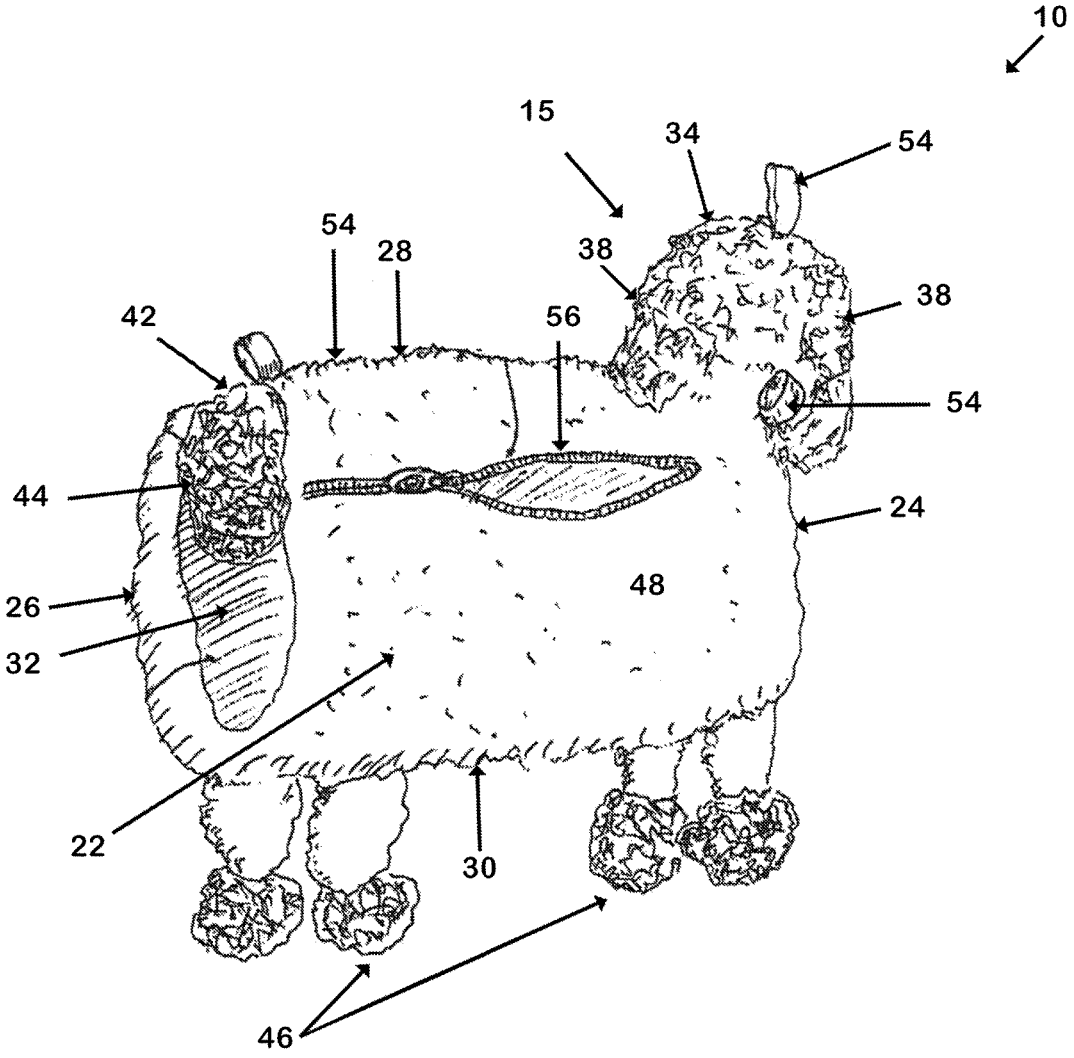
FIG. 2 is a rear elevation view of an example embodiment.

A combination hand muff and purse 10 is rendered in a form reminiscent of an animal 15. In the example embodiment herein illustrated the animal 15 is a mammal having a coat of fur. The combination hand muff and purse 10 includes a front side 20, a rear side 22, a first end 24, a second end 26, a top side 28, and a bottom side 30. An open central cavity 32 is disposed between said front side 20, rear side 22, top side 28 and bottom side 30, and is accessible at each of the first end 24 and second end 26 wherein a user may insert their hands into each of said first and second end 24, 26 to warm inside the central cavity 32.

A head member 34 characterizing the animal 15 is disposed upon the top side 28 proximal the first end 24. The head member 34 may caricaturize the animal 20, or otherwise render the animal 20 features in stylized form to emulate cuteness whereby the animal is attractive to children. The head member 34 includes a pair of eyes 36, ears 38, and a snout 40. The ears 38 may be enlarged, dependent, and floppy.

A tail member 42 characterizing the animal 20 is disposed upon the top side 28 at the second end 26. The tail member 42 may include a tasseled end 44.

A plurality of leg members 46 characterizing the animal 20 is disposed upon the bottom side 30. Each of the pair of leg members 46 is disposed serried upon and consecutively aligned along a common axis upon the bottom side 30, whereby a profile of the animal 20 passant is presented.

A flocculent coat 48 characterizing the animal 20 is disposed exteriorly upon at least the front side 20 and the rear side 22, from the top side 28 to the bottom side 30 and from the first end 24 to the second end 26, and within the central cavity 32. The flocculent coat 48, therefore, serves to insulate and the central cavity 32 and assist in warming a user's hands when held interior to the central cavity 32. The flocculent coat 48 is also soft to the touch.

A first pocket 50 is disposed accessible at the top side 28. The first pocket 50 opens longitudinally along the top side 28 whereby a user may store various items, personal effects, and other accouterments as desired, for portage interior to the first pocket 50. The first pocket 50 is also devised to store a shoulder strap 52, concealable within the first pocket 50 and deployable for attachment at each of a pair of attachment loops 54, whereby the present combination hand muff and purse 10 is portable hands-free akin to a handbag or purse.

Figure 3:
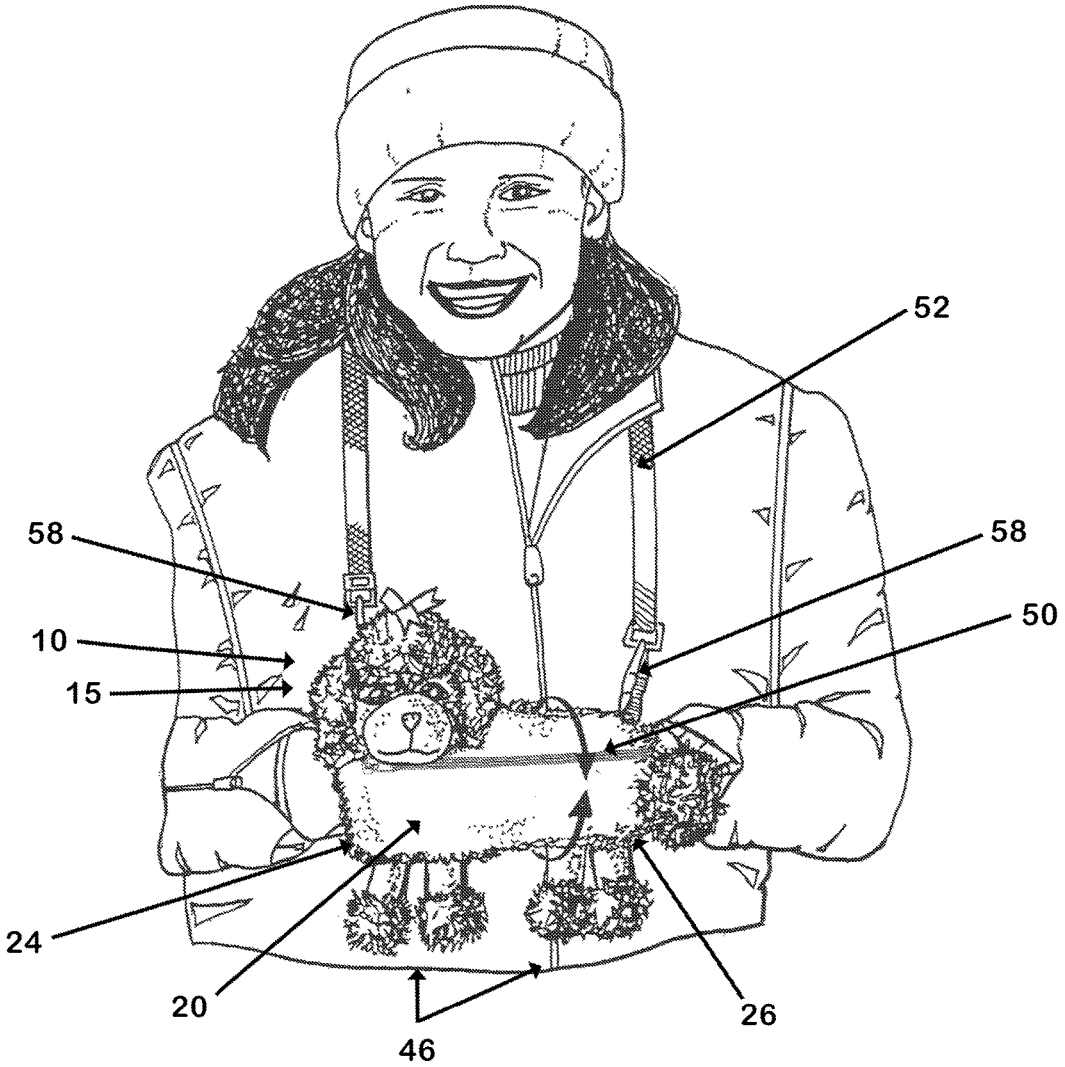
FIG. 3 is an in-use view of an example embodiment.

In the example embodiment illustrated in FIG. 3, a second pocket 56 is disposed accessible upon the front side 20 wherein a user may store additional items, personal effects, and accouterments, as case may be. The second pocket 56 may have an interior volume of different dimensions than the first pocket 50, and may be adapted to house particular items or objects (such as a wallet, for example, change, smart phone, or other such items typically carried by women in the modern age).

Each of the pair of attachment loops 54 is disposed proximal the top side 28 at each of the first and second ends 24, 26. Each of said pair of attachment loops 54 is devised to releasably secure the shoulder strap 52 thereto. In the example embodiment illustrated herein, each of the pair of attachment loops 54 are annulets to which the shoulder strap 52 attaches by action of clips 58 disposed upon the shoulder strap 52. As should be evident to anyone of ordinary skill, additional means of attachment effective between each of the pair of attachment loops 54 and the shoulder strap 52 are contemplated herein, and the particular mechanism shown herein is not considered limiting.

Thus the combination hand muff and purse 10 presents as a purse, a muff, and a toy animal for use porting various items, personal effects, and other accouterments common to the modern age while enabling a user to warm their hands interior to the central channel, as desired.

The invention claimed is:

1. A combination hand muff and purse configured in the form of an animal, said combination hand muff and purse comprising:

a front side;
a rear side;
a first end;
a second end;
a top side;
a bottom side;
a head member characterizing the animal disposed upon the top side proximal the first end;
a tail member characterizing the animal disposed upon the top side at the second end; and
a plurality of leg members characterizing the animal, said plurality of leg members disposed depending from the the bottom side consecutively aligned along a common axis;
an open central cavity disposed between the front side, rear side, top side and the bottom side, said open central cavity accessible at each of the first end and second end;
a first pocket accessible at the top side;
a second pocket accessible upon the rear side; and
a shoulder strap attachable proximal each of the first end and second end.

2. The combination hand muff and purse of claim 1 wherein the shoulder strap is concealable interior to the first pocket and deployable therefrom for attachment proximal each of the first and second ends.

3. The combination hand muff and purse of claim 2 wherein the shoulder strap is attachable proximal each of the first end and the second end at a respective attachment loop devised to releasably secure the shoulder strap thereto.

4. The combination hand muff and purse of claim 3 further comprising a flocculent and soft material by which the combination hand muff and purse is exteriorly lined and insulated.

5. The combination hand muff and purse of claim 4 wherein the head member includes eye members, ear members, and a snout portion.

6. A combination hand muff and purse configured in the form of an animal, said combination hand muff and purse comprising:

a front side;
a rear side;
a first end;
a second end;
a top side;
a bottom side;
an open central cavity disposed between said front side, rear side, top side and bottom side, said central cavity accessible at each of the first end and the second end;
a head member characterizing the animal disposed upon the the top side proximal the first end;
a tail member characterizing the animal disposed upon the top side at the second end;
a plurality of leg members characterizing the animal disposed depending from the bottom side consecutively aligned along a common axis;
a flocculent material characterizing the animal disposed exteriorly at least upon the front side and the rear side, from the top side to the bottom side and from the first end to the second end, and within the central cavity;
a first pocket accessible at the top side;
a second pocket accessible upon the rear side;
a shoulder strap concealable within and deployable from the first pocket, said shoulder strap attachable proximal each of the first end and second end; and
each of a pair of attachment loops disposed proximal the top side at each of the first and second ends, each of said pair of attachment loops devised to releasably secure the shoulder strap thereto.

* * * * *